US007052446B2

(12) United States Patent
Morris et al.

(10) Patent No.: US 7,052,446 B2
(45) **Date of Patent: *May 30, 2006**

(54) LAT PULLDOWN WEIGHT TRAINING MACHINE

(75) Inventors: Michael Wayne Morris, Galax, VA (US); Gregory M. Webb, Independence, VA (US)

(73) Assignee: Nautilus Human Performance Systems, Inc., Independence, VA (US)

( * ) Notice: Subject to any disclaimer, the term of this patent is extended or adjusted under 35 U.S.C. 154(b) by 87 days.

This patent is subject to a terminal disclaimer.

(21) Appl. No.: 10/862,756

(22) Filed: Jun. 7, 2004

(65) Prior Publication Data

US 2004/0229735 A1 Nov. 18, 2004

Related U.S. Application Data

(63) Continuation of application No. 09/886,786, filed on Jun. 21, 2001, now Pat. No. 6,746,378.

(60) Provisional application No. 60/296,775, filed on Jun. 8, 2001.

(51) Int. Cl.
*A63B 21/062* (2006.01)
*A63B 23/02* (2006.01)

(52) U.S. Cl. ..... 482/100; 482/134; 482/137; 482/139

(58) Field of Classification Search ..... 482/44, 482/72, 73, 92–103, 133–139
See application file for complete search history.

(56) References Cited

U.S. PATENT DOCUMENTS 1,205,426 A 11/1916 Barnhill (Continued)

FOREIGN PATENT DOCUMENTS

DE 29801626 U1 * 4/1998

OTHER PUBLICATIONS

STRIVE Pulldown, Target Loading brochure, Strive Enterprises, Inc., 1998.*
Pyramid Fitness Bio-Mechanical Engineers (Booklet).

*Primary Examiner*—Gregory L. Huson
*Assistant Examiner*—Victor K. Hwang
(74) *Attorney, Agent, or Firm*—Myers Bigel Sibley & Sajovec

(57) ABSTRACT

An exercise machine for exercising muscles in the back of an exerciser, includes: a frame; a seat assembly attached to the frame; a movement arm pivotally attached to the frame and movable along a stroke path between an upper forward position and a lower rearward position; a resistance-imparting unit operatively connected with the movement arm to provide resistance to the movement arm as it moves from the forward position to the rearward position; a pair of handles to be grasped by the exerciser; and a pair of extension members, each of which is attached to a respective handle such that each handle is free to rotate about a longitudinal axis of the extension member. The extension members are attached to the movement arm such that each extension member is free to at least partially rotate relative to the movement arm about vertical, longitudinal and transverse axes. Also, the extension members are of sufficient length and the extension members are attached to the movement arm (preferably via universal ball joints) so that the handles can be separated by a distance of at least 24 inches when the movement arm is in the rearward position. In this configuration, the exerciser has the option of performing the basic lat pulldown motion with the hands in any orientation, and can pull the handles to multiple positions in front of the chest and shoulders or outside the chest and shoulders.

15 Claims, 8 Drawing Sheets

U.S. PATENT DOCUMENTS

| | | | | |
|---|---|---|---|---|
| 2,921,791 | A | 1/1960 | Berne | |
| 3,759,512 | A * | 9/1973 | Yount et al. | 482/62 |
| 4,911,435 | A | 3/1990 | Johns | |
| 4,949,951 | A | 8/1990 | Deola | |
| 5,273,509 | A | 12/1993 | Vittone | |
| D359,326 | S * | 6/1995 | Deola | D21/675 |
| 5,597,375 | A * | 1/1997 | Simonson | 482/100 |
| 6,004,247 | A | 12/1999 | Webber | |
| 6,491,609 | B1 | 12/2002 | Webber | |
| 6,561,960 | B1 | 5/2003 | Webber | |
| 6,579,213 | B1 * | 6/2003 | Webber et al. | 482/100 |
| 6,605,022 | B1 | 8/2003 | Webber | |
| 6,689,023 | B1 * | 2/2004 | Baumler | 482/100 |
| 6,746,378 | B1 * | 6/2004 | Morris et al. | 482/100 |
| 6,830,542 | B1 * | 12/2004 | Ball et al. | 482/72 |
| 2002/0035017 | A1 * | 3/2002 | Pertegaz-Esteban | 482/92 |
| 2003/0022767 | A1 | 1/2003 | Webber | |
| 2003/0078141 | A1 * | 4/2003 | Webber | 482/100 |
| 2004/0005966 | A1 * | 1/2004 | Chen | 482/100 |

* cited by examiner

LAT PULLDOWN WEIGHT TRAINING MACHINE

RELATED APPLICATIONS

This application is a continuation of U.S. patent application Ser. No. 09/886,786, filed Jun. 21, 2001 now U.S. Pat. No. 6,746,378, which claims priority from U.S. Provisional Patent Application No. 60/296,775, filed Jun. 8, 2001.

FIELD OF THE INVENTION

The present invention relates generally to exercise equipment, and relates more particularly to weight training equipment.

BACKGROUND OF THE INVENTION

Exercise devices, and in particular weight training machines, typically include a mechanical member that the user repeatedly moves along a prescribed path for exercise. Conventionally, movement of the mechanical member is resisted in some fashion (often by weights) to render the movement more difficult and thereby intensify the exercise. The movement of the mechanical member determines what muscle or muscle groups are to be involved in the exercise.

One popular exercise movement for weight training is the "pull-down" motion, in which a seated exerciser extends his arms over his head to grasp a handle or other grasping device and pulls the handle downwardly toward his shoulders. This movement (often termed a "lat pulldown") can be performed by pulling the handle to a position in front of or behind the exerciser's neck, and can be performed with the hands relatively close together or spread apart wider than the shoulders. This exercise movement tends to work the muscles of the upper arms and shoulders (such as the biceps and deltoids), the neck and back (such as the trapezius, the rhomboids, and the latissimus dorsi), the pectoralis major, and the teres major.

In one type of lat pulldown machine, the handles grasped by the exerciser are either attached at the end of a cable or belt (often it is a single handle that is grasped with both hands). This configuration enables the user to pull downwardly with both hands at once, usually with the hands oriented so that the palms are either facing each other or pronated 90 degrees from facing each other. However, with a single handle the user must have both hands oriented in the same direction, and the placement of the hands on the handle defines the vertical plane in which the hands move during the exercise (i.e., the direction of movement of the cable or belt).

Another type of lat pulldown machine has one or two pivoting movement arms to which the grasping handles are attached. This type of machine typically has only a single path of motion available for exercise, and is often limited to a single orientation of the hands during grasping.

In view of the foregoing, it would be desirable to provide a lat pulldown machine that can provide multiple orientations of the hands and multiple vertical planes of movement during exercise, as doing so can exercise different muscles or portions thereof.

SUMMARY OF THE INVENTION

The present invention can provide a lat pulldown machine that has the capability of enabling the exerciser to employ multiple hand positions and multiple vertical planes of movement. In some embodiments, the inventive exercise machine, which can exercise many of the back muscles of an exerciser, comprises: a frame; a seat assembly attached to the frame; a movement arm pivotally attached to the frame and movable along a stroke path between an upper forward position and a lower rearward position; a resistance-imparting unit operatively connected with the movement arm to provide resistance to the movement arm as it moves from the forward position to the rearward position; a pair of handles to be grasped by the exerciser; and a pair of extension members, each of which is attached to a respective handle such that each handle is free to rotate about a longitudinal axis of the extension member. The extension members are attached to the movement arm such that each extension member is free to at least partially rotate relative to the movement arm about vertical, longitudinal and transverse axes. Also, the extension members are of sufficient length and the extension members are attached to the movement arm (preferably via universal ball joints) so that the handles can be separated by a distance of at least 24 inches when the movement arm is in the rearward position. In this configuration, the exerciser has the option of performing the basic lat pulldown motion with the hands in any orientation, and can pull the handles along multiple vertical planes to multiple positions in front of the chest and shoulders or outside the chest and shoulders.

In other embodiments of the present invention, an exercise machine comprises: a frame; a seat assembly attached to the frame; a movement arm pivotally attached to the frame and movable along a stroke path between an upper forward position and a lower rearward position; a resistance-imparting unit operatively connected with the movement arm to provide resistance to the movement arm as it moves from the forward position to the rearward position; a pair of handles to be grasped by the exerciser; and a pair of extension members, each of which is attached to a respective handle such that each handle is free to rotate about a longitudinal axis of the extension member. The extension members are attached to the movement arm such that each extension member is free to at least partially rotate relative to the movement arm about vertical, longitudinal and transverse axes. Also, the distance between the attachment of each extension member with the movement arm and the attachment of each extension member with its respective handle is between about 8 and 48 inches. This configuration can provide the same benefits to the exerciser mentioned above.

DETAILED DESCRIPTION OF THE INVENTION

Figure 1:
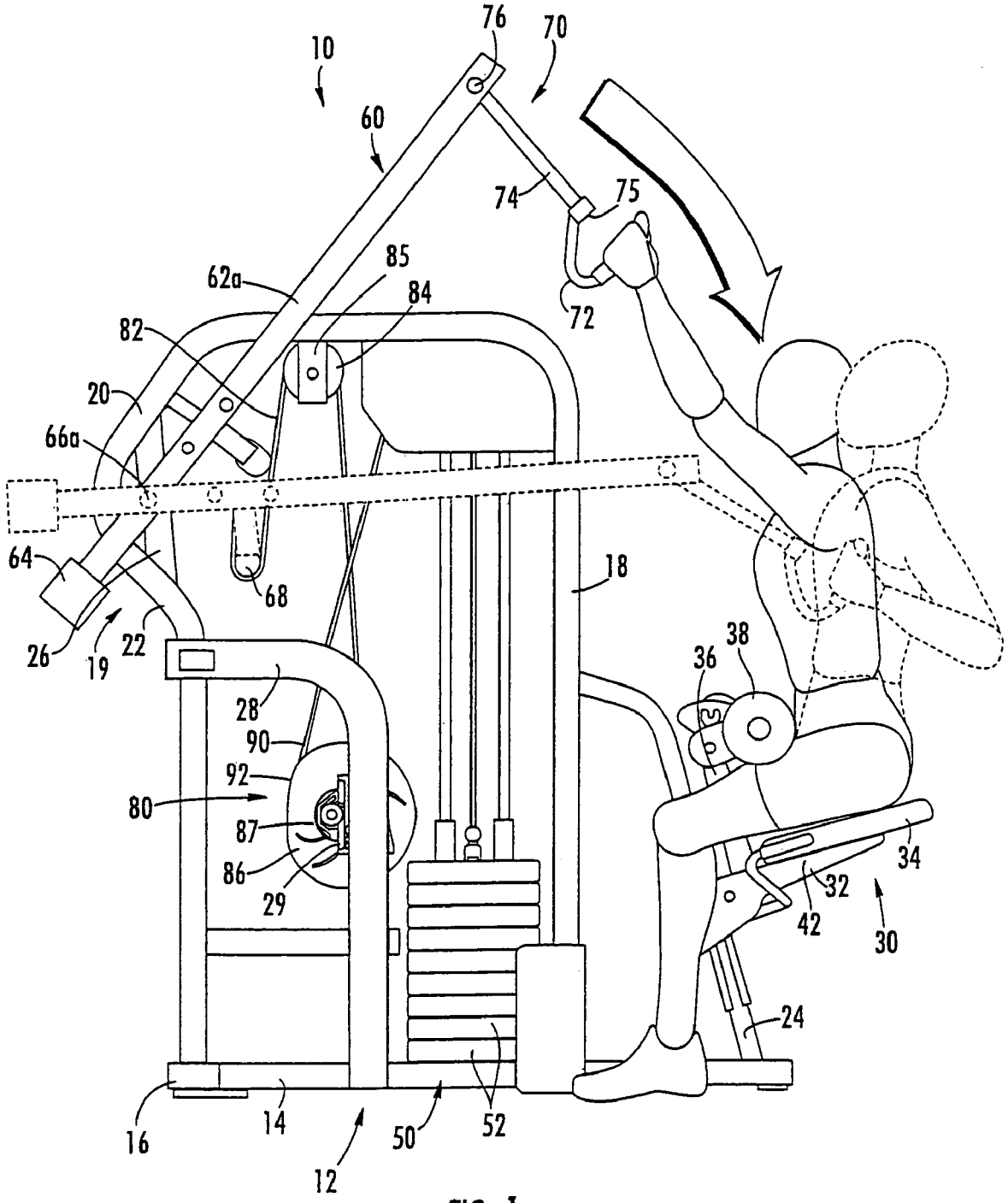
FIG. 1 is a side view of an embodiment of the lat pulldown weight training machine of the present invention, with the upper forward position of the movement being illustrated in solid line and the lower rearward position being illustrated in dotted line.
Figure 2:
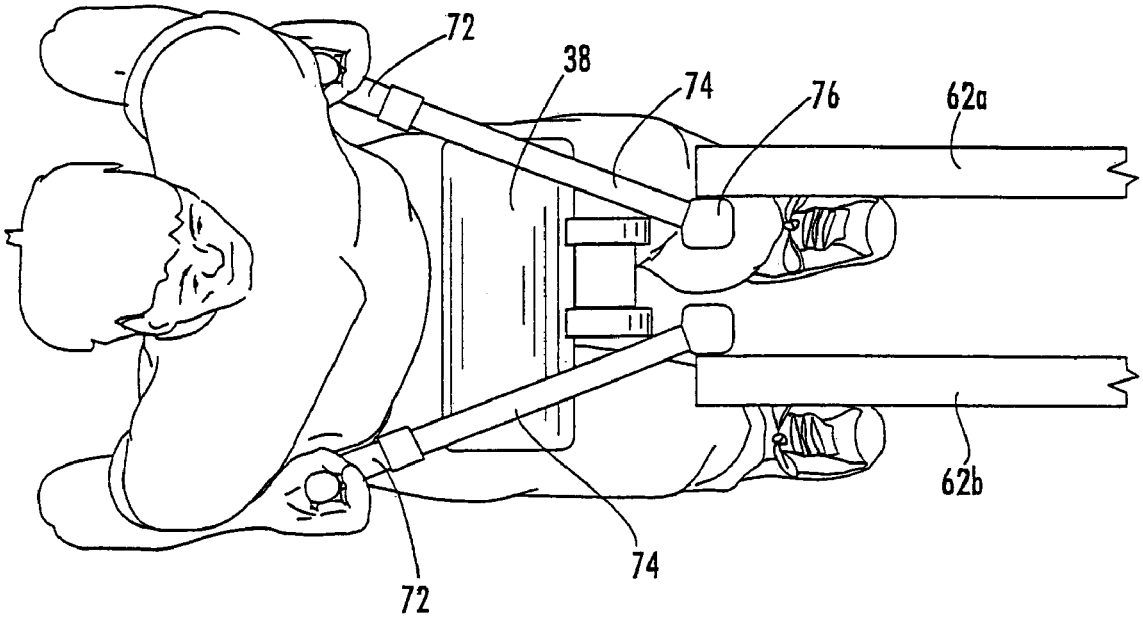
FIG. 2 is a partial top view of the machine of FIG. 1 showing the handles being pulled to the chest and oriented vertically.
Figure 3:
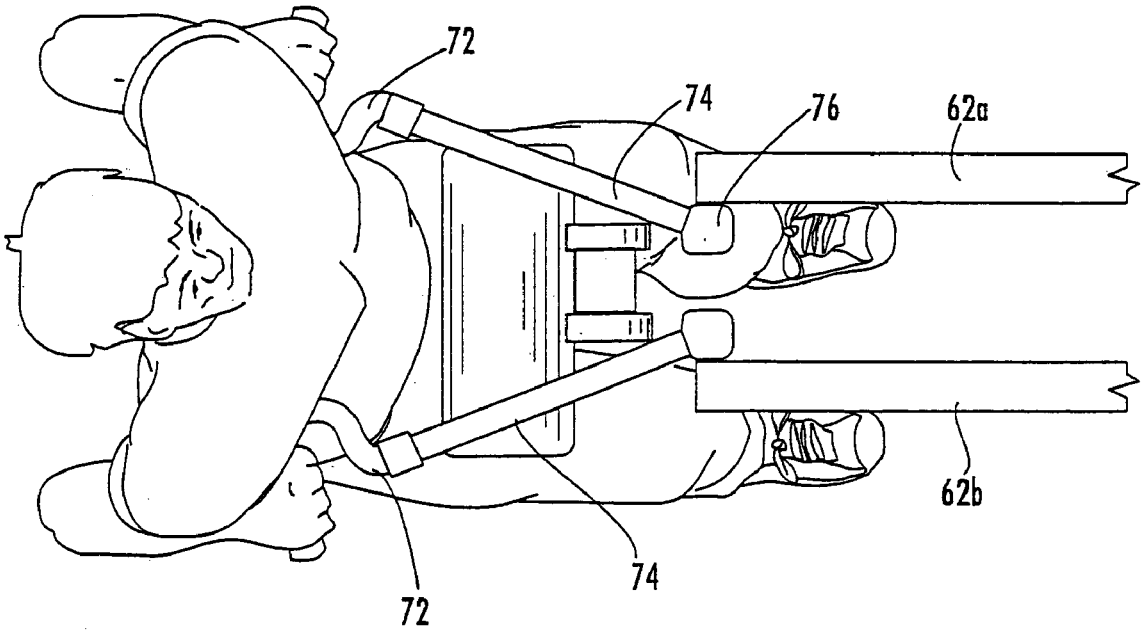
FIG. 3 is a partial top view of the machine of FIG. 1 showing the handles being pulled to the chest and oriented horizontally.
Figure 4:
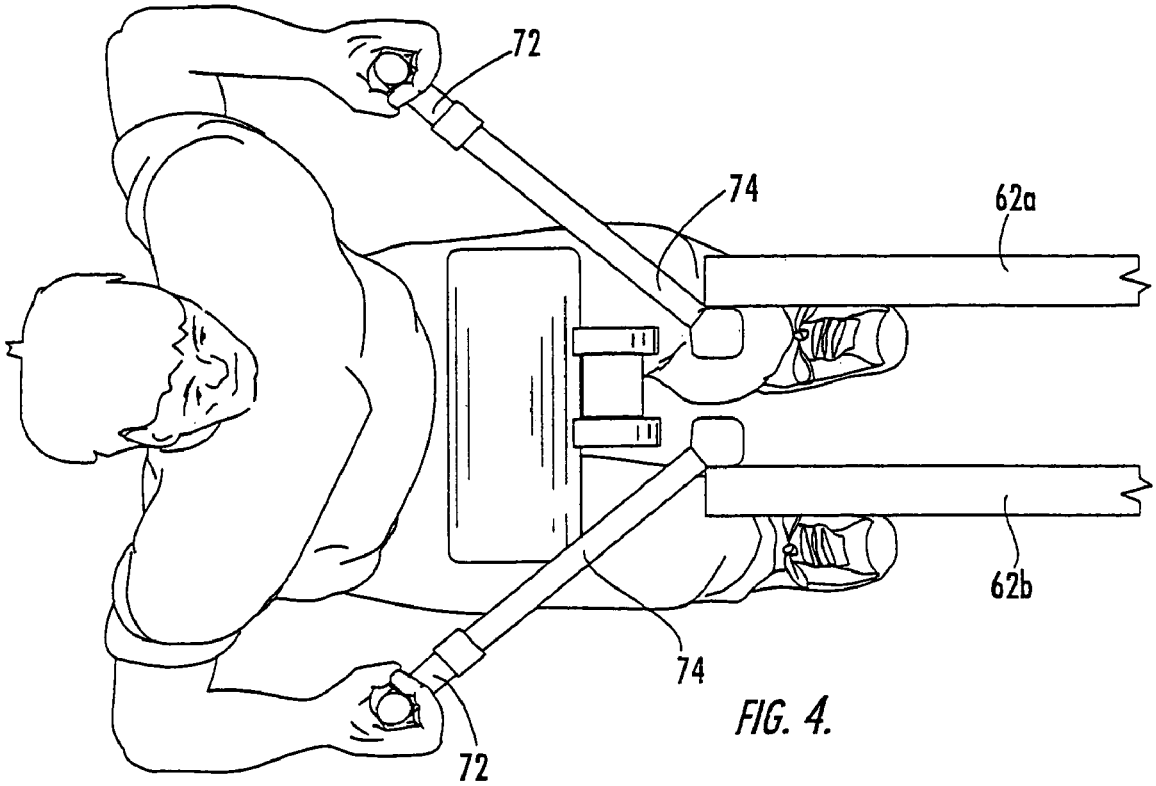
FIG. 4 is a partial top view of the machine of FIG. 1 showing the handles being pulled outside the shoulders and oriented vertically.
Figure 5:
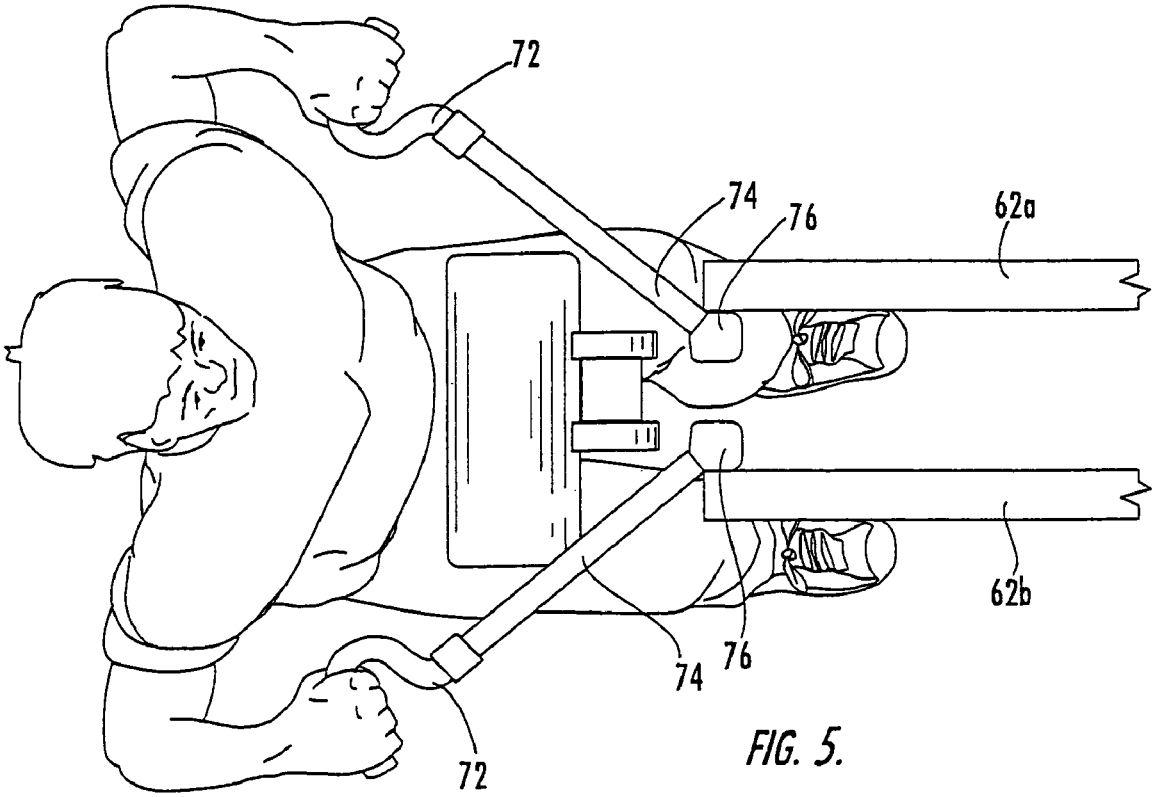
FIG. 5 is a partial top view of the machine of FIG. 1 showing the handles being pulled outside the shoulders and oriented horizontally.

The present invention will now be described more fully hereinafter, in which preferred embodiments of the invention are shown. This invention may, however, be embodied in different forms and should not be construed as limited to the embodiments set forth herein. Rather, these embodiments are provided so that this disclosure will be thorough and complete, and will fully convey the scope of the invention to those skilled in the art. In the drawings, like numbers refer to like elements throughout. Thicknesses and dimensions of some components may be exaggerated for clarity.

Referring now to the drawings, an exercise machine, designated broadly at 10, is illustrated in FIGS. 1–9. The exercise machine 10 includes a frame 12, a seat assembly 30, a weight stack 50, a handle assembly 70, and a belt system 80. These components are described in more detail below.

In describing the lat pulldown machine 10, it will be assumed for the purposes of description that the terms "front", "forward", and derivatives thereof refer to the horizontal direction a seated exerciser faces (i.e., to the left as shown in FIG. 1). The term "rear" and derivatives thereof refer to the horizontal direction that is opposite the "forward" direction (i.e., to the right as shown in FIG. 1). Together, the "forward" and "rear" directions comprise the "longitudinal" dimension of the machine 10. The terms "outward", "outer" and derivatives thereof refer to the horizontal direction defined by a vector beginning at the center of the machine 10 and extending perpendicularly to the longitudinal dimension; conversely, the terms "inner", "inward" and derivatives thereof refer to the horizontal direction opposite the "outward" direction. Together, the "inward" and "outward" directions comprise the "transverse" dimension of the machine 10.

Figure 7:
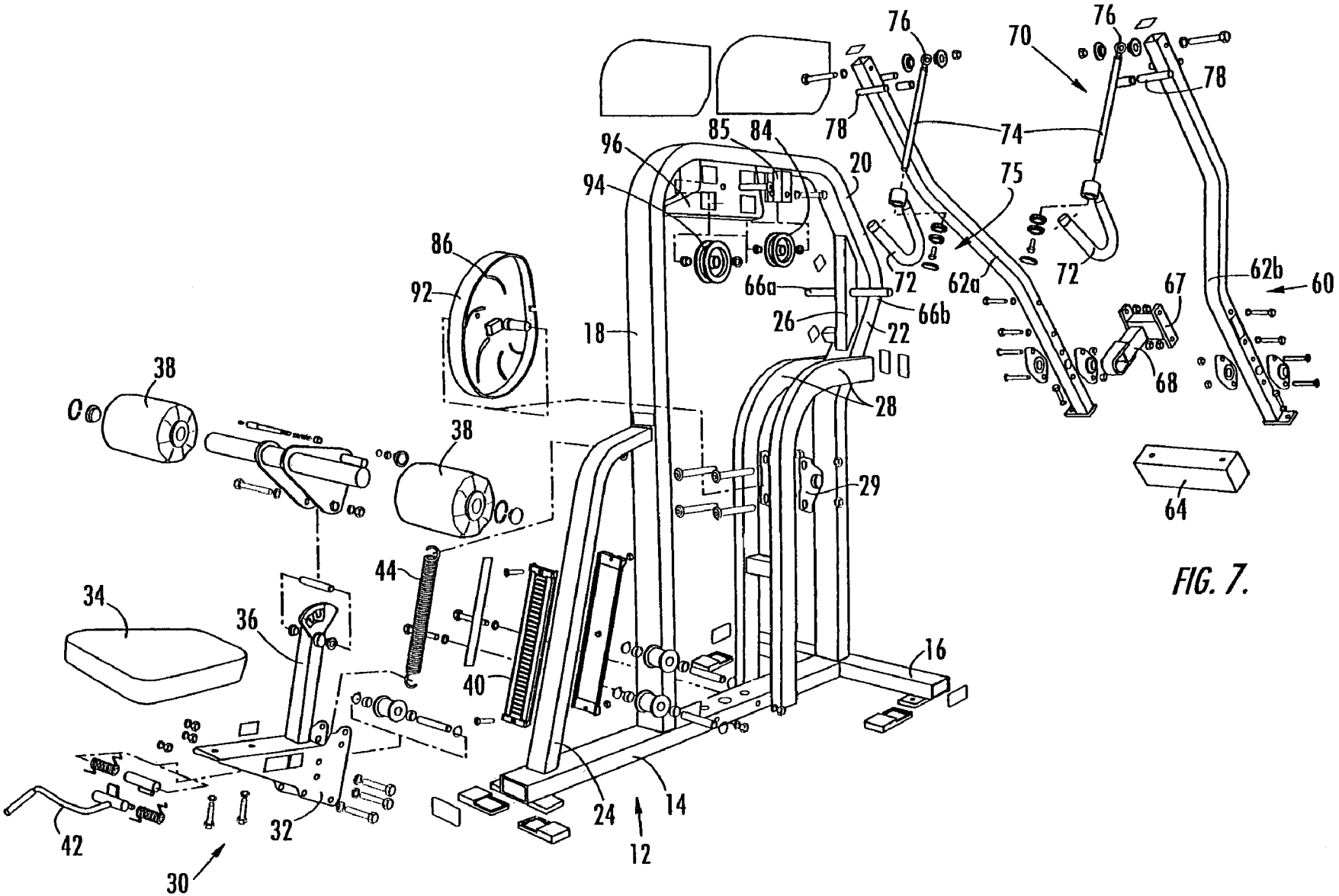
FIG. 7 is an exploded perspective view of the frame, seat assembly, movement arm assembly, pulleys and cam of the exercise machine of FIG. 1.
Figure 8A:
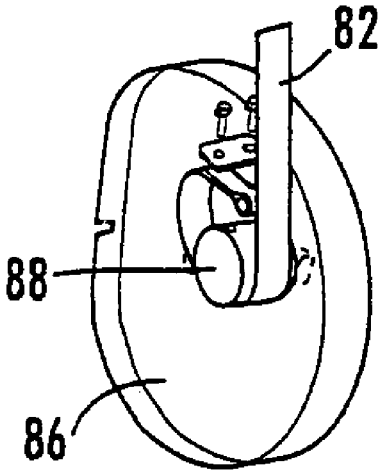
FIG. 8 is a partial perspective view of the belt/pulley system of the machine of FIG. 1, with the opposite side of the cam being shown in FIG. 8A.
Figure 8:
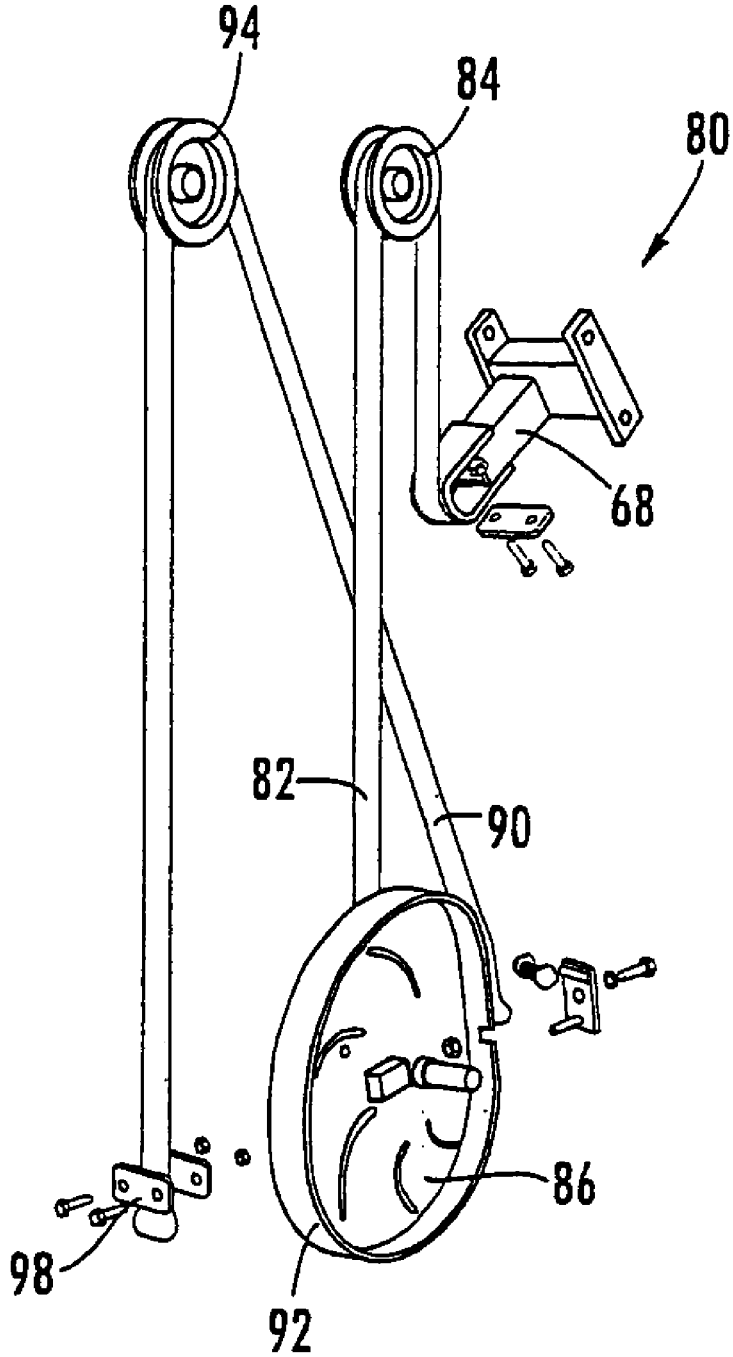

Referring now to FIGS. 1 and 7, the frame 12 includes a longitudinally extending base member 14 that rests on an underlying surface and a transversely extending cross-member 16 that is attached to one end of the base member 14. An upright arch 18 is attached at one end to the intersection of the base member 14 and the cross-member 16 and at its opposite end to an intermediate portion of the base member 14. The arch 18 includes a forwardly-extending protrusion 19 that includes an upper angled portion 20 and a lower angled portion 22. The frame 12 also includes a seat support member 24 that slopes from the rear end portion of the base member 14 upwardly and forwardly to attach to an intermediate portion of the arch 18. A movement arm support 26 extends generally vertically between the upper and lower angled portions 20, 22 of the protrusion 19. A pair of L-shaped cam support members 28 extend upwardly from the base member 14, then extend forwardly to connect to the arch 18 just below the protrusion 19.

Those skilled in this art will recognize that the frame 12 illustrated herein is exemplary and can take many configurations that would be suitable for use with the present invention. The frame 12 provides a strong, rigid foundation to which other components can be attached at desired locations, and other frame forms able to serve this purpose may also be used with this invention.

Referring again to FIGS. 1 and 7, the seat assembly 30 includes a seat bracket 32 that supports a seat 34. A thigh pad support 36 is mounted to and extends upwardly from the seat bracket 32 and supports a pair of adjustable thigh pads 38 that extend transversely therefrom and are positioned above the forward portion of the seat 34. The seat bracket 32 engages an adjustable seat track 40 that is attached to the rear surface of the seat support member 24; interaction between the seat bracket 32 and serrations in the track 40 enable the height of the seat 34 to be adjusted, with a handle 42 facilitating adjustment of the height of the seat 34. Also, a spring 44 attaches between the seat bracket 34 and the upper portion of the seat support member 24 to bias the seat 34 upwardly, thereby providing a snug fit for the seat 34. The configuration of the seat assembly is well-known to those skilled in this art and need not be described in detail herein. Also, those skilled in this art will recognize that other seat configurations, both adjustable and non-adjustable in position, may be suitable for use with the present invention.

Figure 9:
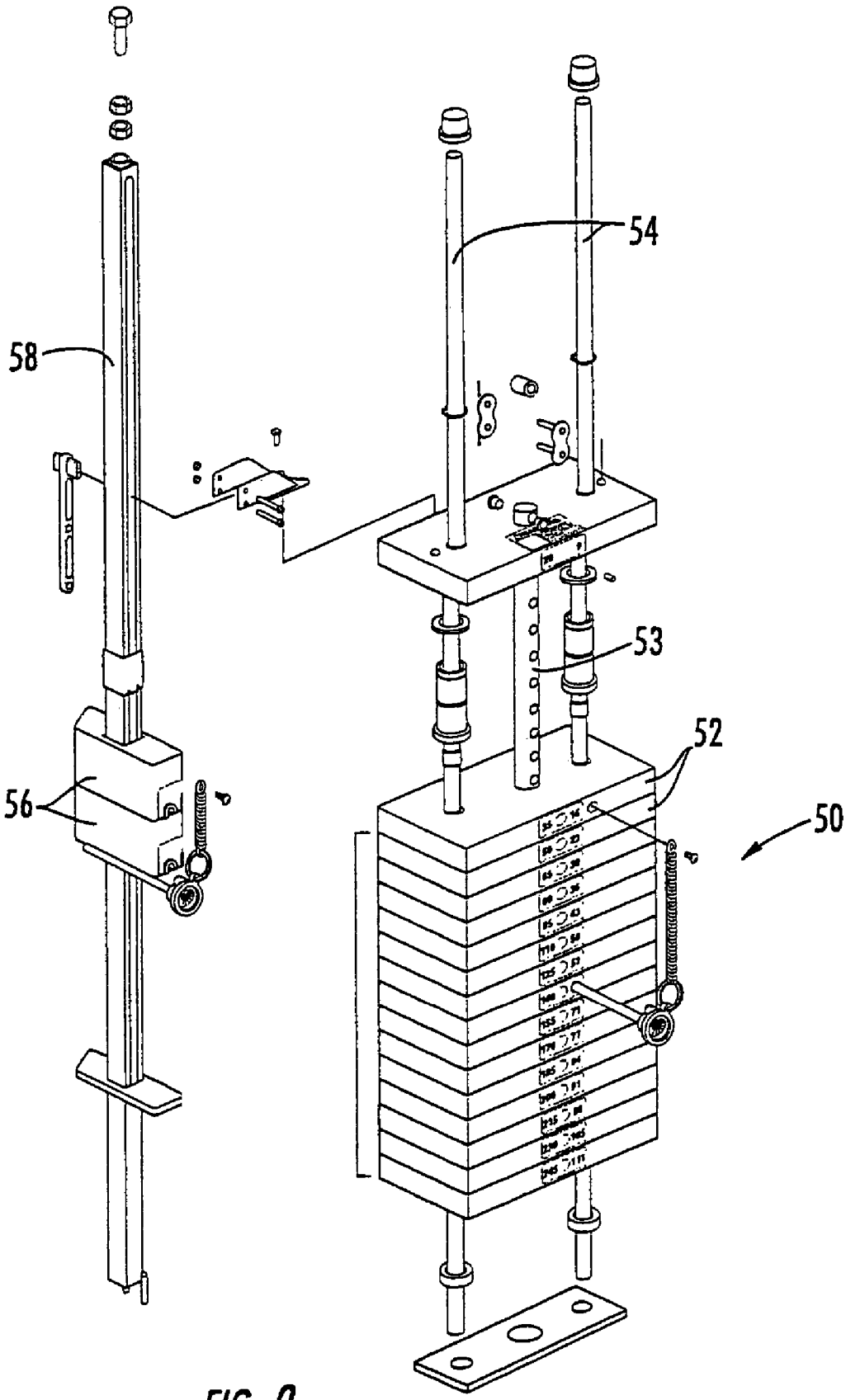
FIG. 9 is a partial exploded perspective view of the weight stack of the machine of FIG. 1.

Referring now to FIGS. 1 and 9, the weight stack 50 includes a set of weights 52 arranged in a vertical stack above the base member 14 just forward of the rear portion of the arch 18. A lifting rod 53 extends vertically through apertures in the weights 52 and is configured to receive a pin inserted between individual weights 52 that enables the user to select the number of weights to be used in the exercise. The weight stack 50 also includes guide rods 54 that extend vertically through the weights 52 to guide the weights 52 along a substantially vertical path during exercise. Weight stacks of this variety are well known to those skilled in this art and need not be described in detailed herein. In addition, the lat pulldown machine 10 includes a set of auxiliary weights 56 that slide along a vertical guide rod 58 and that can be temporarily connected with the selected weights 52 to provide incremental weight during exercise. Again, auxiliary weight systems of this type are well known to those skilled in this art and need not be described in detail herein. An exemplary machine having such a weight stack is a leg extension machine available from Nautilus BPS, Inc. (Independence, Va.) under the trade name NITRO™.

Those skilled in this art will recognize that, although a weight stack is the preferred structure for providing resistance to the exerciser, other resistance-imparting structures, such as friction-imparting devices, variable viscosity devices, air drag-based resistance devices, and the like, may also be employed with a lat pulldown machine of the present invention. Exemplary resistance devices include those illustrated in U.S. Pat. Nos. 5,810,696; 4,708,338; 4,720,093; 5,033,733; 4,542,897; 4,298,893; 4,805,901; 4,790,528; 4,786,049; 5,031,900; 4,775,145; 4,589,656; and 4,659,074, the disclosures of each of which are hereby incorporated herein by reference in their entireties.

Referring back to FIGS. 1 and 7, the movement arm assembly 60 includes a pair of movement arms 62*a*, 62*b* that are attached to the movement arm support 26 via transversely-extending pivot pins 66*a*, 66*b* mounted on the movement arm support 26. The movement arms 62*a*, 62*b* are attached to each other via a counterweight 64 mounted to their forward ends. Another cross-member 67 extends between the movement arms 62*a*, 62*b* rearward of the pivot pins 66*a*, 66*b* and includes a downwardly-extending belt attachment finger 68. As the movement arms 62*a*, 62*b* extend rearwardly beyond the cross member 67, they each veer outwardly, then return to a longitudinal path, such that they form a general "Y" shape; the rearward ends of the movement arms 62*a*, 62*b* are typically separated from one another by between about 12 and 24 inches.

Referring still to FIGS. 1 and 7, a handle assembly 70 is attached to the rearward end portion of each movement arm 62*a*, 62*a*. Each handle assembly 70 includes a generally U-shaped handle 72, an extension rod 74 that is rotatably attached to the handle 72, and a ball joint 76 that is attached to the opposite end of the extension rod 74. The ball joint 76 is then attached to a movement arm 62*a*, 62*b*. Attachment via the ball joint 76 enables the extension rod 74 to rotate at least to a certain extent about vertical, longitudinal and transverse axes. Typically, the extension rod 74 can rotate about 270 degrees about the transverse axis, about 50 to 120 degrees about the longitudinal axis, and about 50 to 120 degrees about the vertical axis. At its opposite end, the extension rod 74 is attached to a rotary bearing 75 (such as a sleeve or ball bearing) on the end of the handle 72 such that the handle 72 is free to rotate 360 degrees about the longitudinal axis of the extension rod 74. Preferably, the extension rod 74 is of sufficient length (between about 8 and 48 inches, and more preferably between about 10 and 16 inches) to enable the handles 72 to be separated by between about 6 and 36 inches (and more preferably at least 24 inches) when pulled by the exerciser to a longitudinal position approximately equal to that of the front of the seat 34. In addition, each movement arm 62*a*, 62*b* includes a stop 78 attached near the ball joint 76.

Referring now to FIGS. 1, 7, 8 and 8A, the belt system 80 includes a belt 82 that is attached at one end to the belt attachment finger 68 of the movement arm assembly 60. The belt 82 travels upwardly to engage a pulley 84 that is mounted to the top portion of the arch 18 via a pulley bracket 85. The belt 82 then extends downwardly toward a cam unit 86 that is mounted to the cam support member 28 via a cam-mounting bearing 29 at a pivot 87. The cam unit 86 includes a take-up post 88 to which the belt 82 attaches. The take-up post 88 is eccentrically mounted on the cam unit 86 in order to provide a desired resistance curve. A second belt 90 attaches to the peripheral camming surface 92 of the cam unit 86 and extends upwardly to engage a pulley 94 that is mounted to the upper portion of the arch 18 via a pulley mounting bracket 96. The belt 90 then extends downwardly to attach to lifting rod 53 via a mounting bracket 98.

In operation, the exerciser selects a desired resistance from the weight stack 50. At this point the movement arms 62*a*, 62*b* are in the upper forward position illustrated in solid line in FIG. 1. The exerciser then sits upon the seat 34 and adjusts the thigh pad 38 to a comfortable height. The exerciser then grasps the handles 72 of the handle assembly 70 and pulls downwardly and rearwardly to the lower rearward position illustrated in FIG. 1 in dotted line. Doing so causes the movement arms 62*a*, 62*b* to pivot about the pivot pins 66. This pivotal movement also draws the belt attachment finger 68 downwardly, which draws the belt 82 over the pulley 84. This action of the belt 82 causes the cam unit 86 to rotate about the pivot 87 (this pivotal movement is counterclockwise from the vantage point of FIG. 1). The rotation of the cam unit 86 causes the belt 90 to be taken up on the camming surface 92. The portion of the belt 90 attached to the lifting rod 53, and in turn to the weights 52, is drawn upwardly, thereby providing resistance to the exerciser.

Notably, the ball joints 76 enable the user to hold the handles 72 in a variety of different positions that can exercise different portions of the body. For example, the handles 72 can be rotated about the axes defined by their respective extension rods 74 and therefore may be oriented vertically, horizontally, or some intermediate position, each of which will cause different muscle groups to be exercised. For example, if the handles 72 are held vertically (see FIGS. 2 and 4), the latissimus dorsi are emphasized, while a horizontal orientation of the handles 72 (see FIGS. 3 and 5) causes exercise of the lower trapezius to be more intense.

In addition, the presence of the ball joints 76 enables the extension rods 74 to veer outwardly (away from the center of the body) during exercise, again providing exercise to different muscle groups in the body. In particular, the inclusion of the extension rods 74 between the ball joints 76 and the handles 72 allows the exerciser to position the handles farther apart than the typical width of a human body (for example the handles 72 may be separated by between 6 and 36 inches, with a permissible separation distance of at least 24 inches being preferred) while still enabling the handles 72 to be turned and/or raised during exercise. Thus, with the handles 72 drawn to a position adjacent the shoulders or chest (see FIGS. 2 and 3), exercise of the latissimus dorsi may be emphasized, while drawing the handles 72 to a position 2 inches outside the shoulders (see FIGS. 4 and 5) can exercise the anterior and posterior deltoids more intensely.

Figure 6:
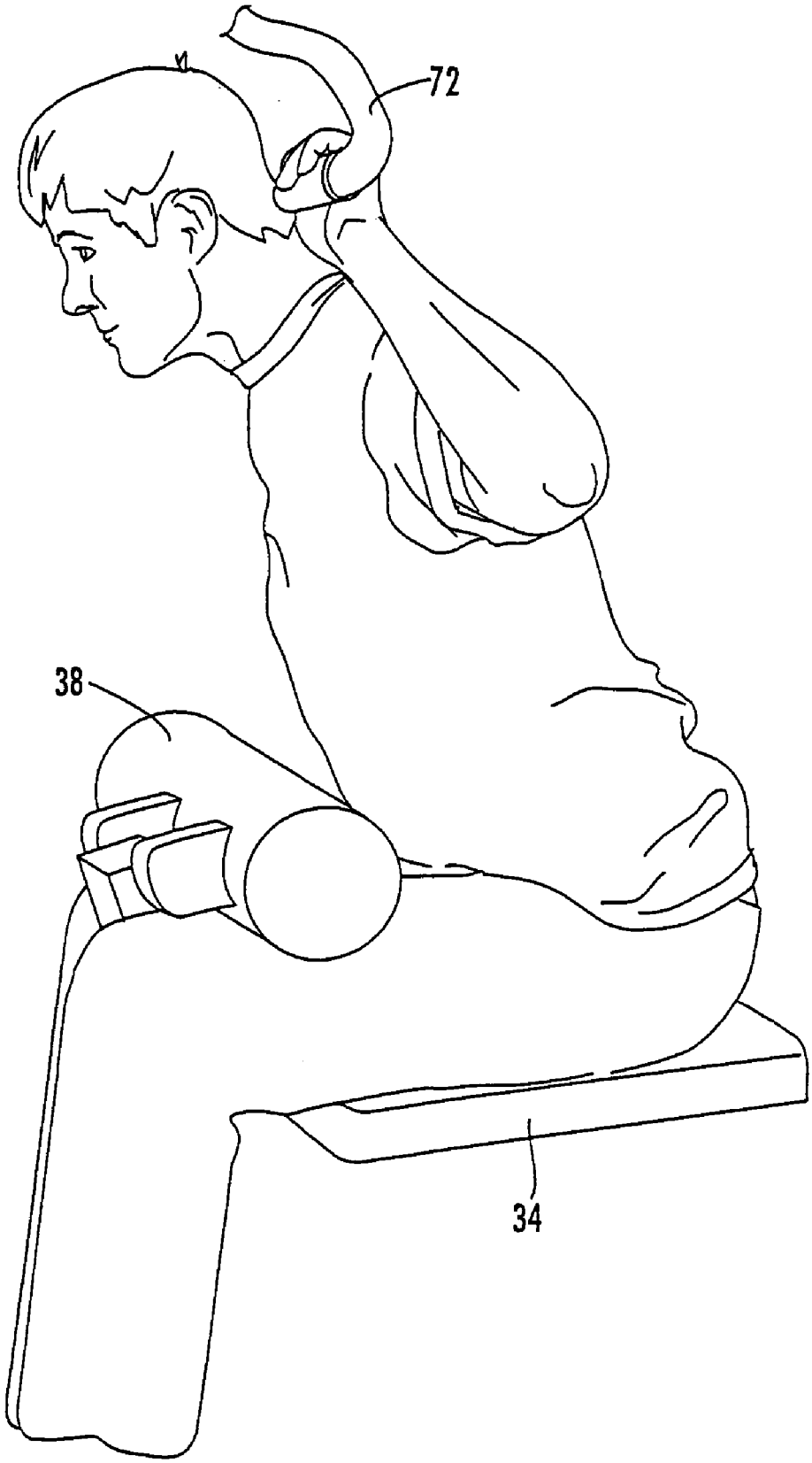
FIG. 6 is a partial perspective view showing the handles being pulled behind the head.

Moreover, the ball joints 76 enable the exerciser to pull the handles 72 to different elevations on the body. For example, FIGS. 2–5 demonstrate the pulling motion of the exerciser drawing the handles 72 to the chest level of the exerciser, while FIG. 6 illustrates the exerciser bringing the handles 72 to a position behind the exerciser's head, which can bring the trapezius and rhomboids into the exercise.

Those skilled in this art will appreciate that other structures, such as rubber joints, cable joints, universal joints, hook and loop joints, chain links, or dual axis joints, may be used in place of the ball joints 76. The replacement structures should be capable of allowing the extension rods 74 to rotate at least partially about vertical, longitudinal and transverse axes.

Figure 10:
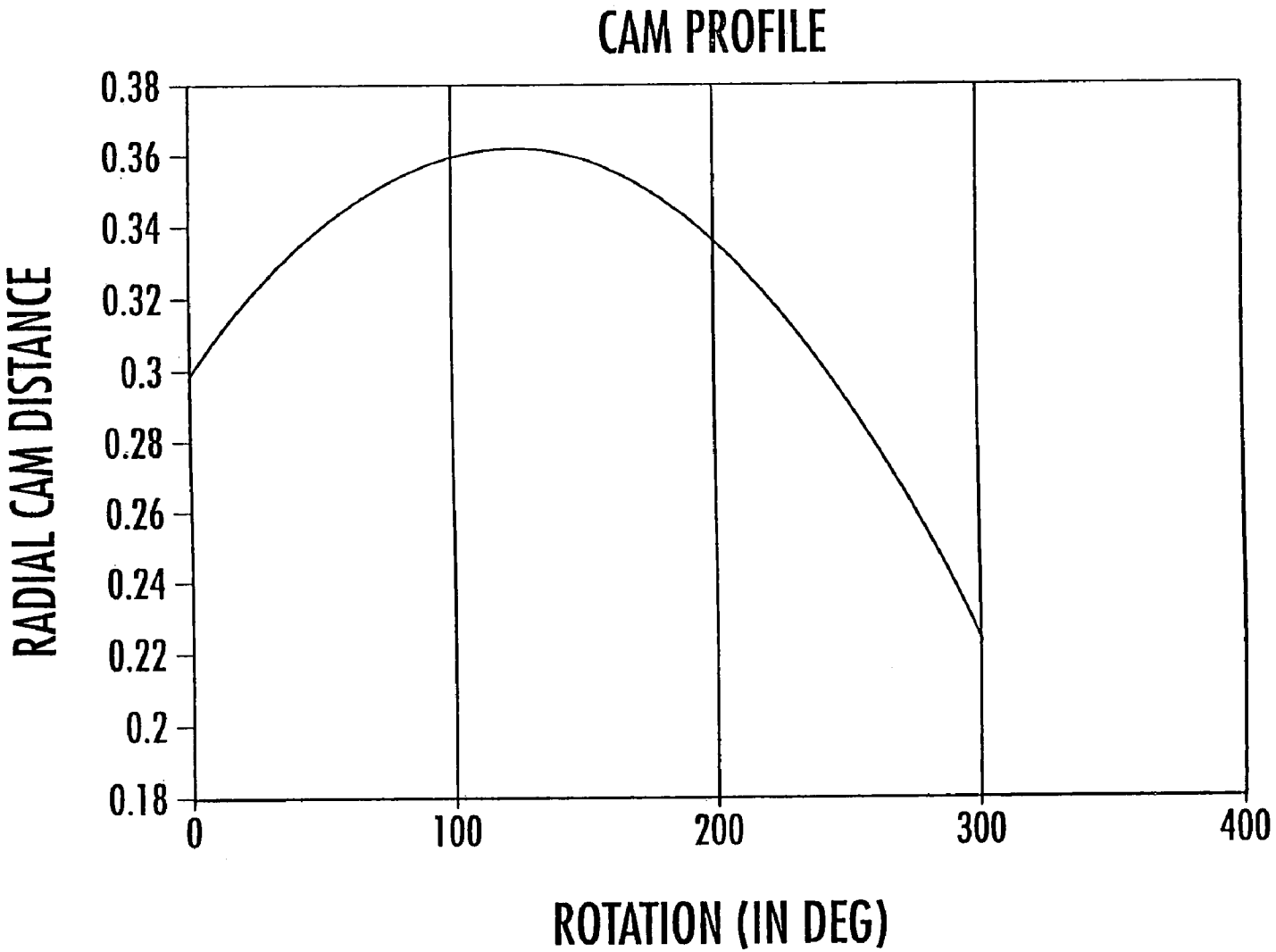
FIG. 10 is a graph plotting resistance as a function of movement arm displacement for the machine of FIG. 1.

Further, the configuration of the cam unit 86 controls the resistance curve experienced by the exerciser during exercise. Fundamentally, it is desirable to vary the resistance experienced by the exerciser at different points during movement; otherwise, the magnitude of resistance necessary to provide a strengthening workout to a muscle or muscle group may be too high to enable the user to move the movement arm through positions in the full range of motion in which the user enjoys a lower mechanical advantage. In the illustrated embodiment, the non-circular surface 92 of the cam 86 causes the resistance experienced by the exerciser to follow the resistance curve illustrated in FIG. 10. Those skilled in this art will recognize that, although a non-circular cam is preferred to provide a varying resistance curve to the machine 10, other structures, such as four-bar linkages and the like, can also be employed to vary the resistance of the machine during exercise.

The foregoing is illustrative of the present invention and is not to be construed as limiting thereof. Although exemplary embodiments of this invention have been described, those skilled in the art will readily appreciate that many modifications are possible in the exemplary embodiments without materially departing from the novel teachings and advantages of this invention. Accordingly, all such modifications are intended to be included within the scope of this invention as defined in the claims. The invention is defined by the following claims, with equivalents of the claims to be included therein.

That which is claimed is:

1. An exercise machine for exercising muscles in the back of an exerciser, comprising:

a frame;

a seat assembly attached to the frame;

a movement arm pivotally attached to the frame and movable along a stroke path between an upper forward position and a lower rearward position;

a resistance-imparting unit operatively connected with the movement arm to provide resistance to the movement arm as it moves from the forward position to the rearward position;

a pair of handles to be grasped by the exerciser;

a pair of rigid extension members, each of which is attached to a respective handle, wherein each handle is attached to its respective extension member such that each handle is free to rotate with respect to the extension member about a longitudinal axis of the extension member;

wherein the extension members are attached to the movement arm such that each extension member is free to at least partially rotate relative to the movement arm about vertical, longitudinal and transverse axes; and wherein the movement arm and extension members are configured such that, when the movement arm is in the upper forward position, the user's hands reach above his head, and in the lower rearward position, the user's hands are positioned below his head.

2. The exercise machine defined in claim 1, wherein each of the extension members is attached to the movement arm via a ball joint.

3. The exercise machine defined in claim 1, wherein each handle is attached to its respective extension member via a rotary bearing.

4. The exercise machine defined in claim 1, further comprising a unit that varies the resistance imparted to the exerciser by the resistance-imparting unit along the stroke path.

5. The exercise machine defined in claim 4, wherein the unit that varies resistance comprises a non-circular cam that engages a belt connected with the resistance-imparting unit.

6. The exercise machine defined in claim 5, wherein the resistance-imparting unit comprises a weight stack.

7. The exercise machine defined in claim 1, wherein the extension members are of sufficient length and the extension members are attached to the movement arm so that the handles can be moved to within a distance of 6 inches of each other when the movement arm is in the rearward position.

8. The exercise machine defined in claim 7, wherein a distance between the attachment of each extension member with the movement arm and the attachment of each extension member with its respective handle is between about 8 and 48 inches.

9. An exercise machine for exercising muscles in the back of an exerciser, comprising:

a frame;

a seat assembly attached to the frame;

a movement arm pivotally attached to the frame and movable along a stroke path between an upper forward position and a lower rearward position;

a resistance-imparting unit operatively connected with the movement arm to provide resistance to the movement arm as it moves from the forward position to the rearward position;

a pair of handles to be grasped by the exerciser;

a pair of extension members, each of which is attached to a respective handle, wherein each handle is attached to its respective extension member via a rotary bearing such that each handle is free to rotate about a longitudinal axis of the extension member;

wherein the extension members are attached to the movement arm via a ball joint such that each extension member is free to at least partially rotate relative to the movement arm about vertical, longitudinal and transverse axes; and wherein the movement arm and extension members are configured such that, when the movement arm is in the upper forward position, the user's hands reach above his head, and in the lower rearward position, the user's hands are positioned below his head.

10. The exercise machine defined in claim 9, wherein each handle is attached to its respective extension member via a rotary bearing.

11. The exercise machine defined in claim 9, further comprising a unit that varies the resistance imparted to the exerciser by the resistance-imparting unit along the stroke path.

12. The exercise machine defined in claim 11, wherein the unit that varies resistance comprises a non-circular cam that engages a belt connected with the resistance-imparting unit.

13. The exercise machine defined in claim 12, wherein the resistance-imparting unit comprises a weight stack.

14. The exercise machine defined in claim 9, wherein the extension members are of sufficient length and the extension members are attached to the movement arm so that the handles can be moved to within a distance of 6 inches of each other when the movement arm is in the rearward position.

15. The exercise machine defined in claim 14, wherein a distance between the attachment of each extension member with the movement arm and the attachment of each extension member with its respective handle is between about 8 and 48 inches.

* * * * *